US009758947B2

(12) United States Patent
Serrurier et al.

(10) Patent No.: US 9,758,947 B2
(45) Date of Patent: Sep. 12, 2017

(54) MOUNTING BASE FOR WEAR MEMBER

(71) Applicant: CATERPILLAR INC., Peoria, IL (US)

(72) Inventors: Douglas Serrurier, Peoria, IL (US); Arun Venugopal, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 48 days.

(21) Appl. No.: 14/919,144

(22) Filed: Oct. 21, 2015

(65) Prior Publication Data

US 2016/0130791 A1 May 12, 2016

Related U.S. Application Data

(60) Provisional application No. 62/076,966, filed on Nov. 7, 2014.

(51) Int. Cl.
*E02F 9/28* (2006.01)

(52) U.S. Cl.
CPC ..... *E02F 9/2883* (2013.01)

(58) Field of Classification Search
CPC ..... E02F 9/2883; E02F 9/2841; E02F 9/2825; E02F 9/2858; E02F 9/2833; E02F 3/60
USPC ..... 37/446, 452–460; 172/772, 772.5
See application file for complete search history.

(56) References Cited

U.S. PATENT DOCUMENTS

| | | | | |
|---|---|---|---|---|
| 5,241,765 | A | 9/1993 | Jones et al. | |
| 5,564,508 | A * | 10/1996 | Renski | E02F 9/2883 172/772 |
| 5,937,549 | A | 8/1999 | Bender et al. | |
| 6,194,080 | B1 | 2/2001 | Stickling | |
| 6,393,739 | B1 | 5/2002 | Shamblin et al. | |
| 8,356,432 | B2 | 1/2013 | Carpenter | |
| 2004/0216335 | A1 | 11/2004 | Jones | |
| 2008/0092413 | A1 | 4/2008 | McClanahan et al. | |
| 2014/0173949 | A1 * | 6/2014 | Karlsson | E02F 9/2825 37/455 |

FOREIGN PATENT DOCUMENTS

| | | |
|---|---|---|
| AU | 2010100656 | 7/2010 |
| WO | WO2011156834 A1 | 12/2011 |
| WO | 2012159155 | 11/2012 |

OTHER PUBLICATIONS

Chan, Stephanie, "Quick and Safe Heel Shroud Change Out," Quarry Magazine, Jun. 10, 2014, www.quarrymagazine.com/Article.aspx?id=3813&h=Quick-and-safe-heel-shroud-change-out, (2 pages), Melbourne, Australia.

(Continued)

*Primary Examiner* — Robert Pezzuto
(74) *Attorney, Agent, or Firm* — Finnegan, Henderson, Farabow, Garrett & Dunner, LLP

(57) ABSTRACT

A mounting base for removably coupling a wear member to a tool may have a generally planar first base portion, which may have an inward surface configured to be attached to the tool. The mounting base may also have a generally planar second base portion extending from the first base portion in a direction generally perpendicular to the first base portion. The second base portion may have an inward surface configured to be attached to the tool. The first base portion may define an opening including a notch-shaped portion and a rectangle-shaped portion.

12 Claims, 13 Drawing Sheets

(56) References Cited

OTHER PUBLICATIONS

BYG, "BYG Mining Products", Brochure, www.anmopyc.com/resources/archivos/noticias/16/byg_mining_2013_final(3)(1).pdf, accessed Sep. 9, 2014, (32 pages).
Futura, "Futura wear technology, High Performance Wear Part," Brochure, www.byg.com/brochures/futura/FF-500_2014/filesFF500EN/assets/common/downloads_f81f81b3/FF-500_2014_BU-Layout%201.pdf, accessed Sep. 9, 2014, (28 pages).
"New Sandvik bucket shroud system delivers major time and safety benefits," IM International Mining, May 23, 2014, http://im-mining.com/2014/05/23/new-sandvik-bucket-shroud-system-delivers-major-time-and-safety-benefits/, (3 pages).
Sandvik, "Sandvik GET—Mechanical Heel Shroud," Youtube Video, Published on Aug. 28, 2013, www.youtube.com/watch?v=kX1-iAhFqZE, (2 pages).
"CAT 280-4078 Heel Shroud," Catalog, https://parts.cat.com/en/catcorp/get/heel-shrouds/280-4078, accessed Sep 9, 2014, (1 page).
"CAT 280-4079 Heel Shroud," Catalog, https://parts.cat.com/en/catcorp/get/heel-shrouds/280-4079, accessed Sep. 9, 2014, (1 page).
"CAT 138-6529 Heel Shroud," Catalog, https://parts.cat.com/en/catcorp/get/heel-shrouds/138-6529, accessed Sep. 9, 2014, (1 page).
"CAT 138-6551 Heel Shroud," Catalog, https://parts.cat.com/en/catcorp/get/heel-shrouds/138-6551, accessed Sep. 9, 2014. (1 page).
"CAT 157-1019 Heel Shroud," Catalog, https://parts.cat.com/en/catcorp/get/heel-shrouds/157-1019, accessed Sep. 9, 2014. (1 page).
"CAT 157-1027 Heel Shroud," Catalog https://parts.cat.com/en/catcorp/get/heel-shrouds/157-1027, accessed Sep. 9, 2014. (1 page).
Cat® Products, "Hammerless Bucket Systems for Cat® Wheel Loaders & Excavators," Youtube Video, Published Mar. 12, 2014, www.youtube.com/watch?v=hZWWNhxK2sQ&feature=youtu.be, (2 pages).

* cited by examiner

MOUNTING BASE FOR WEAR MEMBER

RELATED APPLICATIONS

This application is related to and claims the benefit of U.S. Provisional Patent Application No. 62/076,966, filed Nov. 7, 2014, which is incorporated herein by reference in its entirety.

TECHNICAL FIELD

The present disclosure relates generally to a mounting base, and more particularly, to a mounting base for a wear member.

BACKGROUND

Many earth-working machines, such as, for example, loaders, excavators, hydraulic mining shovels, cable shovels, bucket wheels, and draglines, include tools for moving material (e.g., for digging material out of the earth). These tools are often subjected to extreme wear from abrasion and impacts experienced while moving the material. In order to mitigate the wear, replaceable wear members are fit to the tools and engage the material being moved.

U.S. Pat. No. 5,937,549 (the '549 patent) to Bender et al. describes an attachment system for detachably mounting a wear member to a parent member. According to the '549 patent, the attachment system includes a mounting base, which is welded to a single surface of the parent member. The attachment system also includes a wear member, which is mechanically attached to the single surface of the parent member by sliding the wear member onto the mounting base and engaging cooperating engagement elements. Once the wear member is slid onto the mounting base, the '549 patent describes using a removable retainer to maintain the position of the wear member. The wear member may be replaced by removing the retainer and sliding the wear member off of the base, thereby disengaging the cooperating mounting elements.

The attachment system of the '549 patent may provide certain benefits in some applications. However, it may have certain drawbacks. For example, it may be difficult and/or costly to use the attachment system of the '549 patent in applications requiring a wear member that mitigates wear to multiple, non-parallel (e.g., perpendicular) surfaces of a tool. The disclosed embodiments may help solve this and other problems.

SUMMARY OF THE INVENTION

One disclosed embodiment is related to a mounting base for removably coupling a wear member to a tool. The mounting base may include a generally planar first base portion having an inward surface configured to be attached to the tool. The mounting base may also include a generally planar second base portion extending from the first base portion in a direction generally perpendicular to the first base portion. The second base portion may have an inward surface configured to be attached to the tool. The first base portion may define an opening including a notch-shaped portion and a rectangle-shaped portion.

Another disclosed embodiment is related to a mounting base for removably coupling a wear member to a tool. The mounting base may include a generally planar first base portion having an inward surface configured to be attached to the tool. The mounting base may also include a generally planar second base portion extending from the first base portion in a direction generally perpendicular to the first base portion. The second base portion may also include a protrusion extending generally parallel to the first base portion. The protrusions may have an inward surface configured to be attached to the tool. The first base portion may define an opening configured to receive a portion of the wear member.

Yet another disclosed embodiment is related to a mounting base for removably coupling a wear member to a tool. The mounting base may include a generally planar first base portion having an inward surface configured to be attached to the tool. The first base portion may also include a first chamfer surface extending from an end of the first inward surface, and away from the tool when the first inward surface may be attached to the tool. The mounting base may also include a generally planar second base portion extending from the first base portion in a direction generally perpendicular to the first base portion. The second base portion may also have an inward surface configured to be attached to the tool. The second base portion may also include a second chamfer surface extending from an end of the inward surface of the second base portion, and away from the tool when the second inward surface may be attached to the tool. The first base portion may define an opening configured to receive a portion of the wear member.

DETAILED DESCRIPTION

Figure 2:
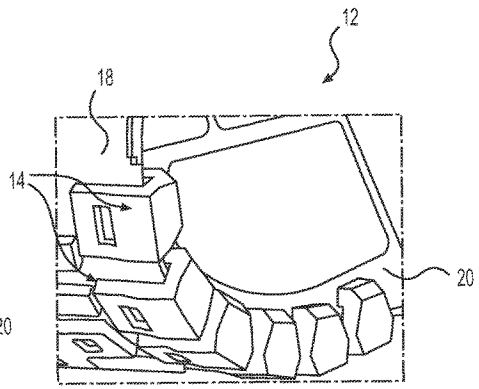
FIG. 2 is an enlarged perspective view of several of the wear member systems of FIG. 1.
Figure 1:
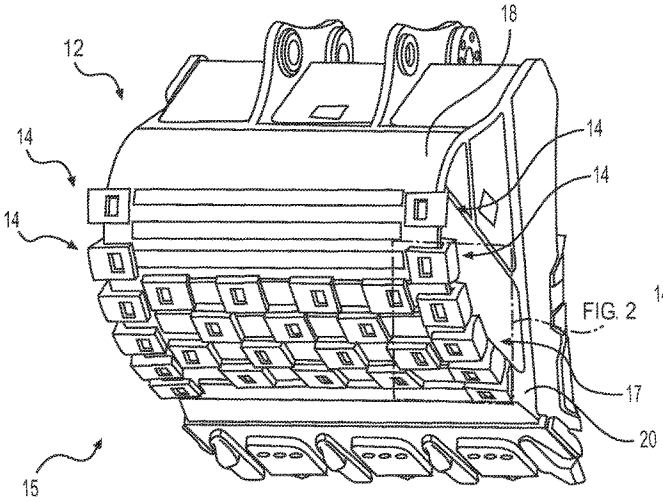
FIG. 1 is a perspective view of a plurality of exemplary disclosed wear member systems installed on a tool.

FIGS. 1-2 illustrate exemplary wear member systems 14, which may be attached to a tool 12. For example, tool 12 may be a bucket (as shown in FIG. 1), a blade, a shovel, a crusher, a grapple, or a ripper, and may be associated with an earth-working machine (e.g., a loader, an excavator, a hydraulic mining shovel, a cable shovel, a bucket wheel, a dragline, or another type of earth-working machine). Tool 12 may be used for moving material (e.g., for digging material out of the earth). Wear member systems 14 may be attached to heels 15, 17 of tool 12, and may mitigate wear from abrasion and impacts experienced by heels 15, 17 while moving the material.

Figure 3:
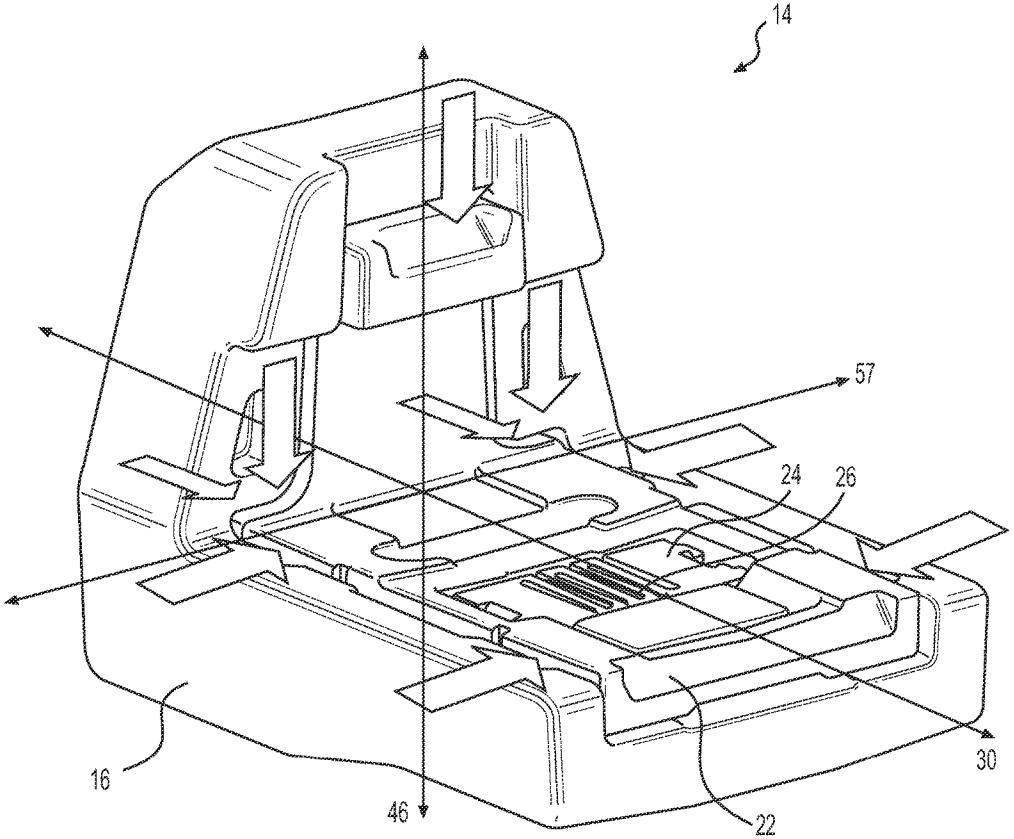
FIG. 3 is a perspective view of one of the wear member systems of FIGS. 1 and 2.
Figure 5:
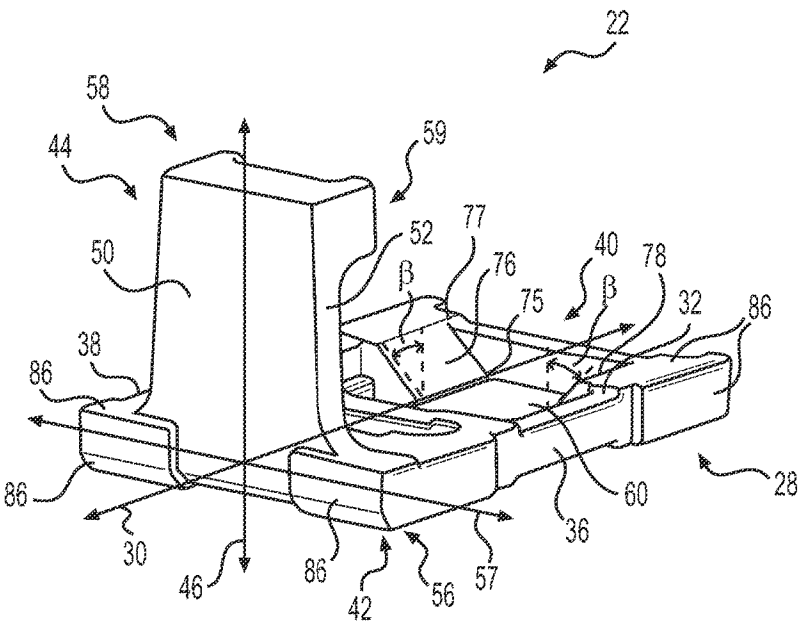
FIG. 5 is another perspective view of the mounting base of FIG. 3, from a different angle.
Figure 4:
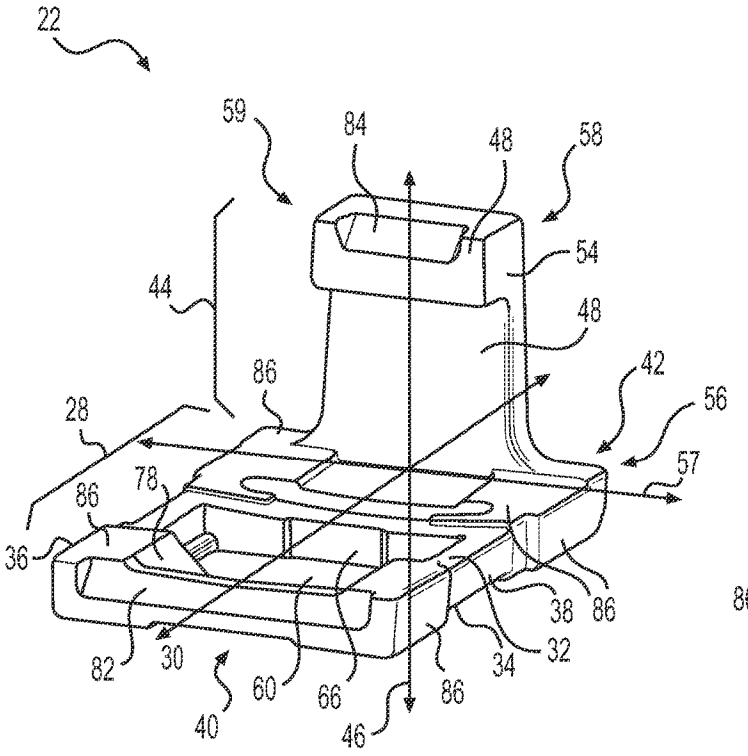
FIG. 4 is a perspective view of an exemplary disclosed mounting base of the wear member system of FIG. 3.
Figure 7:
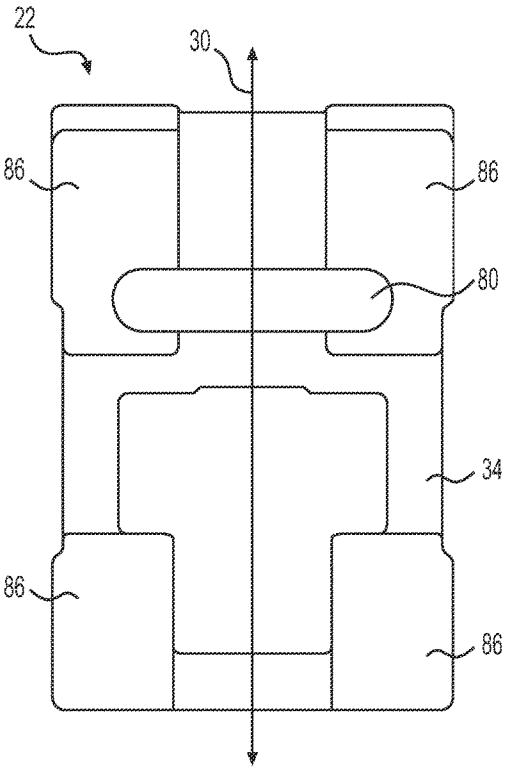
FIG. 7 is a bottom view of the mounting base of FIGS. 4-6.
Figure 6:
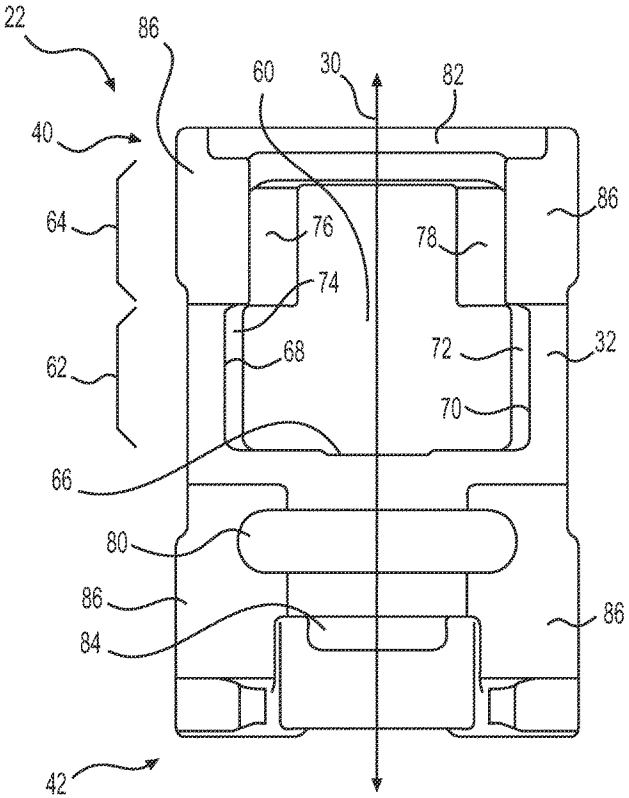
FIG. 6 is a top view of the mounting base of FIGS. 4-5.

Referring to FIG. 3, each wear member system 14 may include a mounting base 22, a wear member 16, a retainer 24, and a plug 26. Mounting base 22 may be configured to be attached (e.g., fixedly) to a first surface 18 and a second surface 20 of tool 12 (referring to FIGS. 1-2). Wear member 16 may be configured to be removably coupled to tool 12 via mounting base 22. Retainer 24 may be configured to keep wear member 16 coupled to mounting base 22 when in a mounted position, and plug 26 may be configured to protect retainer 24.

FIGS. 4-11 illustrate an exemplary mounting base 22 from a variety of angles. As shown, mounting base 22 may include a generally planar first base portion 28 that extends in a longitudinal direction 30. Mounting base 22 may also include a generally planar second base portion 44, which may extend from first base portion 28 in a direction generally perpendicular to first base portion 28, shown as vertical direction 46.

First base portion 28 may be generally rectangular, and may have an inward surface 32 configured to be attached to tool 12. First base portion 28 may also have an outward surface 34 opposite inward surface 32. In addition, first base portion may have a pair of opposite sides 36, 38 that extend generally parallel to longitudinal direction 30. First base portion may also have a pair of opposite ends, first end 40 and second end 42, which extend in a direction generally perpendicular to longitudinal direction 30, shown as latitudinal direction 57.

Referring to FIGS. 4-7, first base portion 28 may define a first opening 60, which may be configured to receive a portion of wear member 16 and a retainer 24 (referring to FIG. 3). First opening 60 may extend along vertical direction 46 from outward surface 34, through first base portion 28, to inward surface 32. First opening 60 may be fully enclosed by first base portion 28. First opening 60 may include a notch-shaped portion 64 for receiving the portion of wear member 16, and a generally rectangle-shaped portion 62 contiguous with notch-shaped portion 64 for receiving retainer 24. It is contemplated that other shapes may be utilized for portion 62 of first opening 60. For example, portion 62 may be square-shaped, circle-shaped, oval-shaped, trapezoid-shaped, or otherwise-shaped. Regardless of its shape, portion 62 may be generally positioned in a central portion of first base portion 28 along longitudinal direction 30 of first base portion 28. Notch-shaped portion 64 may be positioned between rectangle-shaped portion 62 and first end 40.

Rectangle-shaped portion 62 of first opening 60 may have a surface 66 facing notch-shaped portion 64, and a pair of opposite ends 68, 70 that run parallel to longitudinal direction 30. Opposite ends 68, 70 may include a pair of opposing flanges 72, 74, which extend inward toward one another from lower regions of ends 68, 70, adjacent outward surface 34. Opposing flanges 72, 74 may be configured to facilitate retention of retainer 24 when retainer 24 is installed in rectangle-shaped portion 62 of first opening 60.

As used herein, "notch-shaped" is intended to cover an opening with a generally planar bottom surface and angled, generally planar side surfaces joining the bottom surface. Alternatively, the side surfaces may have some degree of curvature if desired. Notch-shaped portion 64 of first opening 60 may be defined by opposing angled surfaces 76, 78 that converge toward each other as they extend from inward surface 32 to outward surface 34. As a result of the convergence, a perimeter 77 of portion 64, which is defined by surfaces 76, 78, at inward surface 32 may be larger than a perimeter 75 of portion 64, which is defined by surfaces 76, 78, at outward surface 34. As shown, surfaces 76, 78 may be symmetrical about vertical direction 46. For example, both surfaces 76, 78 may extend at an angle $\beta$ of about 45 degrees relative to vertical direction 46. Alternatively, both surfaces 76, 78 may extend at another angle relative to vertical direction 46. Alternatively, surfaces 76, 78 may be asymmetrical about vertical direction 46, and may extend at different angles relative to vertical direction 46. In addition, notch-shaped portion 64 when viewed along an axis of first base portion 28 that is generally perpendicular to second base portion 44, may be generally isosceles trapezoid-shaped. Angled surfaces 76, 78 may at least partially define perimeters 77, 75 of notch-shaped portion 64 at inward surface 32 and outward surface 34, respectively. The notch-shaped portion 64 of first opening 60 may be configured such that a perimeter of the notch-shaped portion 64 is smaller at outward surface 34 than at inward surface 32.

First base portion 28 may also include a plurality of loading pads 86 configured to contact tool 12 and wear member 16, as shown in FIGS. 4-11. Loading pads 86 may be configured to transfer loads from wear member 16 to mounting base 22 and tool 12 in directions generally perpendicular to planar first base portion 28, generally perpendicular to planar second base portion 44, and generally parallel to both planar first base portion 28 and planar second base portion 44. Loading pads 86 may include protrusions of first base portion 28. The protrusions may be formed of raised portions of the surfaces surrounding first base portion 28. The protrusions may be generally plateau-shaped in that the raised portions of the first base portion 28 surfaces may extend out to a generally flat outer surface. The outer surfaces of loading pads 86 may constitute raised portions of inward surface 32, outward surface 34, sides 36, 38, and second end 42 depending on the surface they correspond (e.g., is generally parallel) with. For example, the outer surfaces of loading pads 86 that are generally parallel to inward surface 32 may constitute a portion of inward surface 32 and may be referred herein as inward surface 32. Loading pads 86 may be positioned at corners of first base portion 28 and may be configured to substantially surround at least a portion of the corners of first base portion 28. Loading pads 86 may be raised from their corresponding surfaces a distance of, for example, between about 0.5 millimeters to about 4 millimeters. Loading pads 86 raised from inward surface 32 and constituting a portion of inward surface 32 may be configured to contact first surface 18. Loading pads 86 raised from outward surface 34, sides 36, 38, and second end 42 may be configured to contact wear member 16 when wear member 16 is coupled to mounting base 22 (e.g., in the mounted position).

Second base portion 44 may extend from second end 42 of first base portion 28. Second base portion 44 may have an inward surface 48 configured to be attached to tool 12. Second base portion 44 may also have an outward surface 50 opposite inward surface 48. In addition, second base portion 44 may also have a pair of opposite sides 52, 54 that extend from first base portion 28. Second base portion 44 may also have a pair of opposite ends, lower end 56 and upper end 58, that extend in a direction generally perpendicular to longitudinal direction 30.

Figure 11:
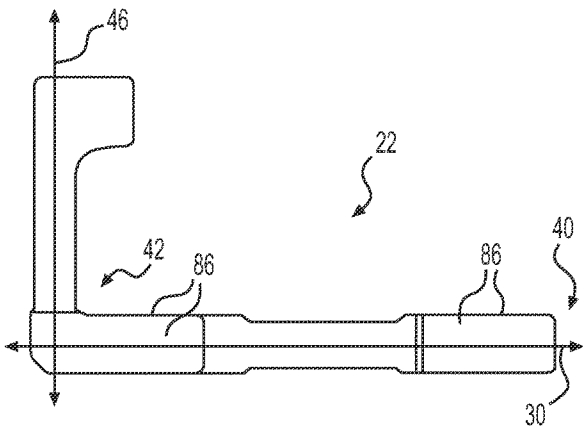
FIG. 11 is a left side view of the mounting base of FIGS. 4-10.

Second base portion 44 may also have a protrusion 59 that extends from upper end 58 in a direction generally parallel to first base portion 28. First base portion 28, second base portion 44, and protrusion 59 may form a generally L-shaped mounting base, as depicted in FIG. 11. As shown, the edges and corners of mounting base 22 may be radiused or rounded to reduce stress as depicted in FIGS. 4-11.

In some embodiments, mounting base 22 may be welded to tool 12. To facilitate such welding, a weld opening 80 may be formed in base 22 to receive weld material, and respective first end 40 and upper end 58 of base portions 28, 44 may include chamfered surfaces to receive weld material. For example, weld opening 80 may be generally oval-shaped, and may be formed in first base portion 28 between rectangle-shaped portion 62 of first opening 60 and second end 42. Alternatively, weld opening 80 may be otherwise-shaped, or may be formed in second base portion 44 or another part of first base portion 28. In yet another alternative, weld openings may be formed in both first and second base portions 28, 44.

At first end 40, first base portion 28 may have a first chamfer surface 82 configured to receive weld material for attaching first base portion 28 to first surface 18 of tool 12. First chamfer surface 82 may extend from an end of inward surface 32 away from tool 12 when inward surface 32 is attached to tool 12. First chamfer surface 82 may extend along first end 40 less than the full length of first end 40.

At upper end 58, second base portion 44 may have a second chamfer surface 84 configured to receive weld material for attaching second base portion 44 to second surface 20 of tool 12. Second chamfer surface 84 may extend from an end of inward surface 48 away from tool 12 when inward surface 48 is attached to tool 12. As shown, second chamfer surface 84 may be positioned at an end of protrusion 59. Second chamfer surface 84 may extend along upper end 58 less than the full length of upper end 58. Weld opening 80, first chamfer surface 82, and second chamfer surface 84 in combination may enable welding of mounting base 22 to tool 12 at three locations.

Referring to FIGS. 4-5 and 8-9, sides 52, 54 of second base portion 44 may be configured to be set in from sides 36, 38 of first base portion 28. Sides 52, 54 may also be configured to converge toward each other as they extend away from first base portion 28. As shown, sides 52, 54 may be symmetrical about vertical direction 46. For example, both sides 52, 54 may extend at an angle $\alpha$ of about 3 degrees relative to vertical direction 46. In other words, second base portion 44 along latitudinal direction 57 at upper end 58 may be narrower than second base portion 44 at lower end 56. The transition of inward surface 32 to sides 52, 54 at second end 42 and lower end 56 may be radiused to reduce stress as depicted in FIGS. 4-5 and 8-9

Figure 9:
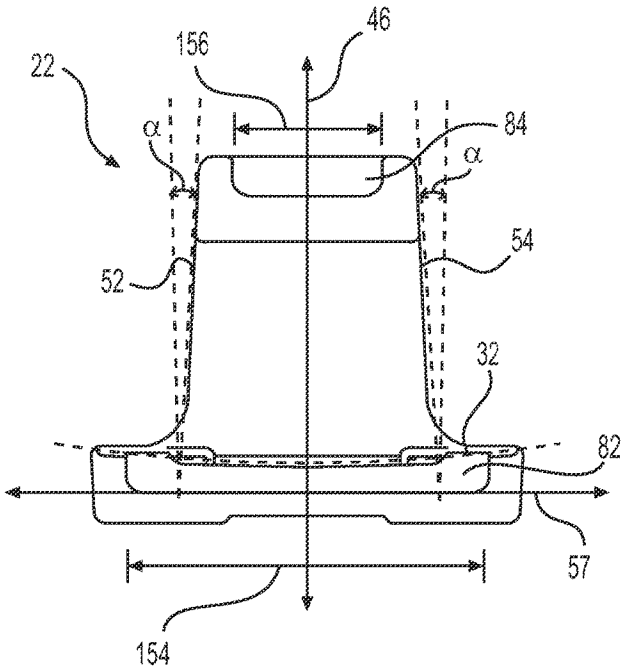
FIG. 9 is a front view of the mounting base of FIGS. 4-8.
Figure 12:
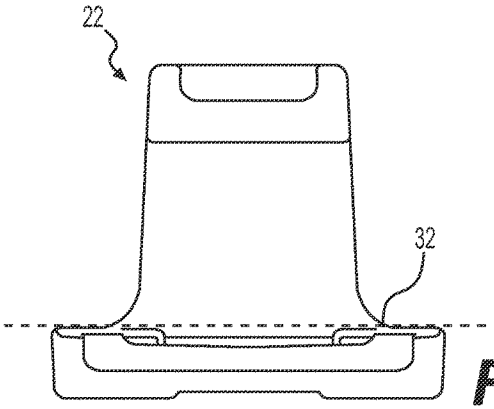
FIG. 12 is a front view of another exemplary disclosed mounting base of one of the wear member systems of FIGS. 1 and 2.

According to one embodiment, as shown in FIGS. 4-11, and as best shown in FIG. 9, inward surface 32 of first base portion 28 including the outer surfaces of loading pads 86 that constitute a portion of inward surface 32, may be concave having a radius of curvature. The radius of curvature of inward surface 32 including the outer surfaces of loading pads 86 that constitute a portion of inward surface 32 may generally correspond with the radius of curvature of first surface 18 at heels 15, 17 of tool 12. The corresponding radius of curvatures of the two surfaces may facilitate a flush mating of the outer surfaces of loading pads 86 that constitute a portion of inward surface 32 and first surface 18. Concave inward surface 32 may have a radius of curvature of between about 400 millimeters and about 800 millimeters. In some embodiments the radius of curvature may be between about 500 millimeters and about 700 millimeters. For example, the radius of curvature may be about 600 millimeters. It is contemplated that other radius of curvatures may be utilized. In another embodiment, as shown in FIG. 12, inward surface 32 of first base portion 28 may be substantially flat. Mounting base 22 having a flat inward surface 32 may be used at first surface 18 of tool 12 where first surface 18 is correspondingly flat to facilitate a flush mating of the surfaces. Besides the difference in the radius of curvature of inward surface 32, mounting base 22 shown in FIG. 12 may otherwise be identical to mounting base 22 shown in FIGS. 4-11.

Figure 8:
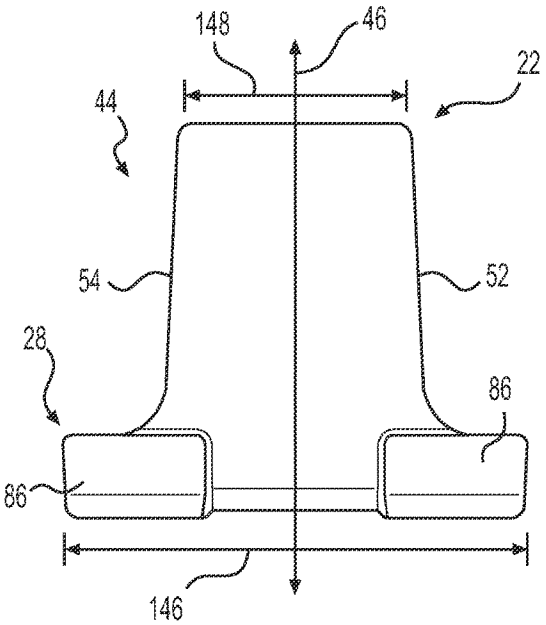
FIG. 8 is a back view of the mounting base of FIGS. 4-7.

Mounting base 22 may vary in size thus enabling mounting base 22 to fit a variety of different sizes of tool 12. Although the size of mounting base 22 may vary in size, the ratio of various dimensions may remain generally the same regardless of the variation in the overall size of mounting base 22 and correspondingly wear member system 14. Referring to FIG. 8, a ratio of a maximum width 146 of first base portion 28 to a maximum width 148 of second base portion 44 at upper end 58, along a direction parallel to both the first base portion 28 and second base portion 44, may be between about 1.5 and about 2.5. In some embodiments, the ratio may be between about 1.75 and about 2.25. For example, the ratio may be about 2. This range of ratios may be beneficial because having second base portion 44 smaller than first base portion 28 may reduce the weight and cost of mounting base 22. However, second base portion 44 must be sufficiently large to maintain the overall structural integrity of mounting base 22.

Figure 10:
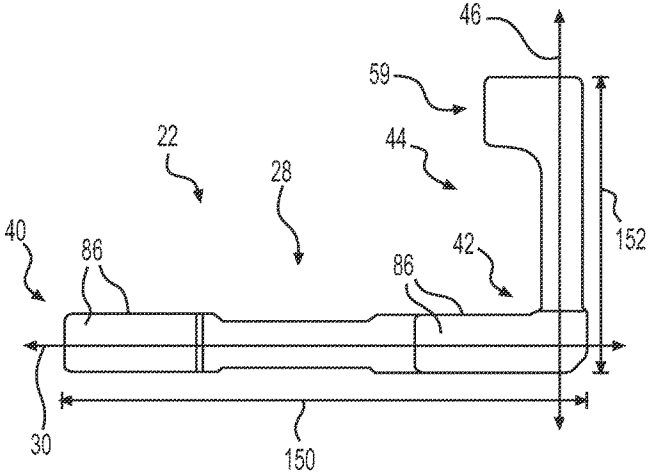
FIG. 10 is a right side view of the mounting base of FIGS. 4-9.

Referring to FIG. 10, a ratio of a maximum length 150 of first base portion 28, along a direction generally perpendicular to second base portion 44, to a maximum height 152 of second base portion 44, along a direction generally perpendicular to first base portion 28 may be between about 1.5 and about 2.0. In some embodiments, the ratio may be between about 1.7 and about 1.8. In some other embodiments, the ratio may be between about 1.75 and about 1.78. For example, the ratio may be about 1.77. This range of ratios may be beneficial because it may provide a suitable size mounting base 22 relative to the tool 12 size while not being so large and heavy that installation and replacement of wear member 16 becomes problematic.

Referring to FIG. 9, a ratio of a width 154 of first chamfer surface 82 to a width 156 of second chamfer surface 84, along a direction parallel to both the first base portion 28 and second base portion 44, may be between about 2.0 and about 3.0. In some embodiments, the ratio may be between about 2.25 and about 2.75. For example, the ratio may be about 2.5. Maximizing the length of the chamfer surfaces may be beneficial in order to ensure mounting base 22 is adequately secured to tool 12.

FIGS. 13-20 illustrate an exemplary wear member 16 from a variety of angles. As shown, wear member 16 may include a generally planar first wear member portion 88 that extends in longitudinal direction 30. Wear member 16 may also include a generally planar second wear member portion 90, which may extend from first wear member portion 88 in a direction generally perpendicular to first wear member portion 88.

First wear member portion 88 may be generally rectangular, and may have a first inward surface 89. First wear member portion 88 may also have a wear surface 94 opposite inward surface 89. As shown, a thickness of first wear member portion 88, in a direction parallel to the direction in which second wear member portion 90 extends, may decrease as first wear member portion 88 extends from second wear member portion 90. First wear member portion 88 may define a second opening 102, which may be configured for pass-through of retainer 24 (referring to FIG. 3). Second opening 102 may extend along vertical direction 46 from wear surface 94, through first wear member portion 88, to inward surface 89. In addition, second opening 102 may be generally rectangle-shaped.

As shown in FIGS. 13-14 and 16-17, wear surface 94 may be convex and have a radius of curvature. The radius of curvature of wear surface 94 may generally correspond with the radius of curvature of first surface 18 at heels 15, 17 of tool 12. The convex wear surface 94 may have a radius of curvature between about 500 millimeters and about 800 millimeters. In some embodiments, the radius of curvature may be between about 600 millimeters and about 700 millimeters. In some other embodiments, the radius of curvature may be between about 650 millimeters and about 660 millimeters. For example, the radius of curvature may be about 655 millimeters.

Second wear member portion 90 may be generally rectangular, and may have a second inward surface 91 contiguous with first inward surface 89 of first wear member portion 88. First inward surface 89 and second inward surface 91 of wear member 16 may define a receiving pocket 96 configured to receive mounting base 22. Receiving pocket 96 may be a generally rectangle-shaped recessed cavity within first wear member portion 88 and second wear member portion 90. As shown, a width of receiving pocket 96 may be less than a width of wear member 16. First wear member portion 88 may include a portion of receiving pocket 96 configured to receive first base portion 28, and second wear member portion 90 may include a portion of receiving pocket 96 configured to receive second base portion 44. The portion of receiving pocket 96 defined by first wear member portion 88 may be open at first end 92, opposite second wear member portion 90. In other words, looking along a longitudinal direction, receiving pocket 96 may be open at first end 92 of first wear member portion 88.

Figure 18:
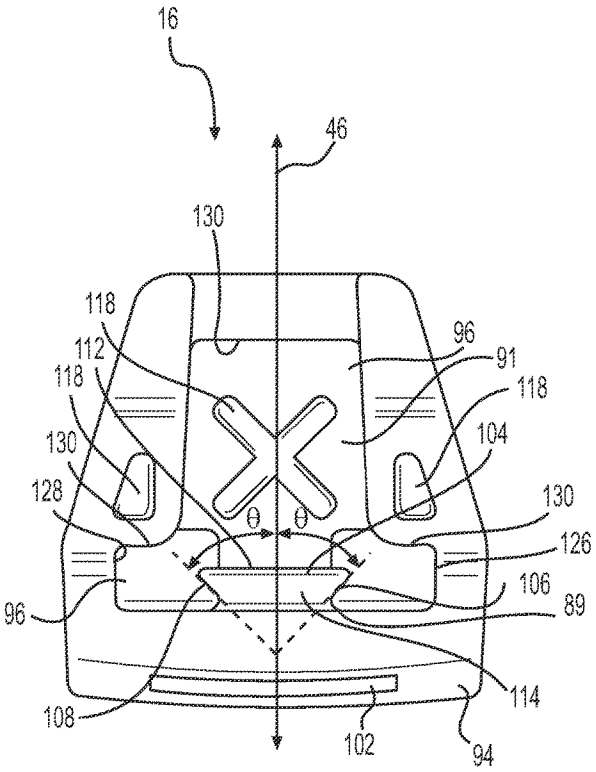
FIG. 18 is a front view of the wear member of FIGS. 13-17.

First inward surface 89 of first wear member portion 88 may define a projection 104 adjacent to second opening 102 configured for removably coupling wear member 16 to mounting base 22 when attached to tool 12. Projection 104 may be positioned between second opening 102 and first end 92 of wear member 16. Projection 104 may have opposite engagement surfaces 106, 108 that may diverge from each other as they extend away from first inward surface 89 within receiving pocket 96 to an upper surface 112 of projection 104. As shown in FIG. 18, engagement surfaces 106, 108 may be symmetrical about vertical direction 46. For example, engagement surfaces 106,108 may extend away from first inward surface 89 at angles ↓ relative to vertical direction 46, for example of about 45 degrees. Projection 104, when viewed along an axis of first wear member portion 88 generally perpendicular to second wear member portion 90, may be generally isosceles trapezoid-shaped. As shown, the joint between each engagement surface 106, 108 and first inward surface 89 may be rounded to reduce stress within projection 104 and first wear member portion 88. The other joints, edges, and corners of wear member 16 may also be radiused or rounded to reduce stress as depicted in FIGS. 13-20.

Projection 104 may also have a front surface 114 and a back surface 116 extending from first inward surface 89 to upper surface 112. Front surface 114 and back surface 116 may be generally perpendicular to first inward surface 89. Projection 104 may be configured to form a dovetail like joint with the notch-shaped portion 64 of first opening 60. In addition, projection 104 may be configured such that a height of projection 104 may be less than a depth of receiving pocket 96 so that projection 104 may be positioned completely within receiving pocket 96. In other words, projection 104 may be configured such that no part of projection 104 extends beyond the boundaries of receiving pocket 96.

Figure 17:
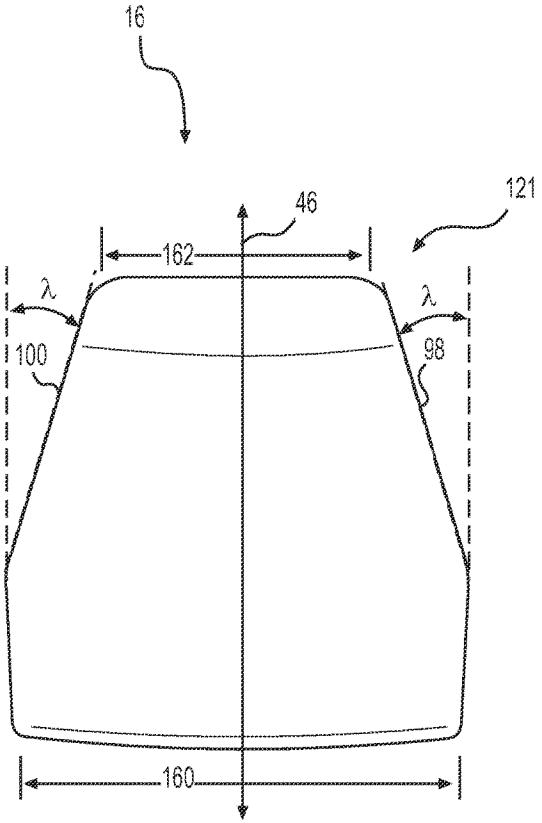
FIG. 17 is a back view of the wear member of FIGS. 13-16.
Figure 20:
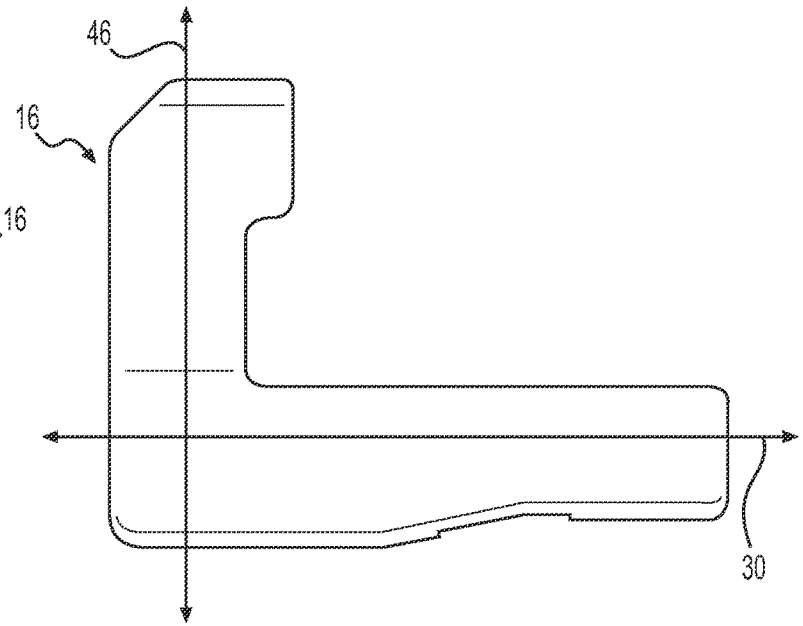
FIG. 20 is a left side view of the wear member of FIGS. 13-19.

Referring to FIGS. 13-14 and 17-18, second wear member portion 90 may have opposite side surfaces 98, 100 that extend from first wear member portion 88. Side surfaces 98, 100 initially diverge away from one another and then pivot and converge towards one another as they extend from first wear member portion 88. As shown in FIG. 17, the converging portions of side surfaces 98,100 may extend at angles $\lambda$ relative to vertical direction 46. Angle $\lambda$ may be between about 15 degree and about 18 degrees. In some embodiments, angle $\lambda$ may be between about 16 degrees and about 17 degrees. For example, angle $\lambda$ may be about 16.75 degrees. It is also contemplated that, in other embodiments, other angles $\lambda$ may be utilized or side surfaces 98, 100 may be parallel.

Wear member 16 may also define one or more wear indicators 118. The wear indicators may be configured to provide an indication as to when wear member 16 should be replaced with a new wear member 16. The indication as to when wear member 16 should be replaced may be, for example when a sufficient portion of the material of wear member 16 is worn off thereby revealing mounting base 22 through one or more of wear indicators 118. In other words, when mounting base 22 becomes visible through wear member 16 at the location of one wear indicator 118, this may act as the indication that wear member 16 should be replaced.

First wear member portion 88 may define a wear indicator 118 formed on inward surface 89 within receiving pocket 96 between rectangle-shaped second opening 102 and a second end 120. Wear indicator 118 may comprise a recess that is recessed into first wear member portion 88 from first inward surface 89 away from receiving pocket 96. Second wear member portion 90 may also define a wear indicator 118 formed on second inward surface 91 in a central region of second wear member portion 90. Wear indicator 118 formed on second inward surface 91 may comprise a recess that is recessed into second inward surface 91 away from receiving pocket 96. By recessing wear indicators 118 away from receiving pocket 96, the indication that wear member 16 should be replaced may occur prior to any wearing of mounting base 22 occurring. The recessed depth of wear indicators 118 from first inward surface 89 within receiving pocket 96 may be between about 1 millimeter and about 5 millimeters. In other embodiments, the depth may be between about 2 millimeters and about 4 millimeters. For example, the depth may be about 3 millimeters.

Figure 13:
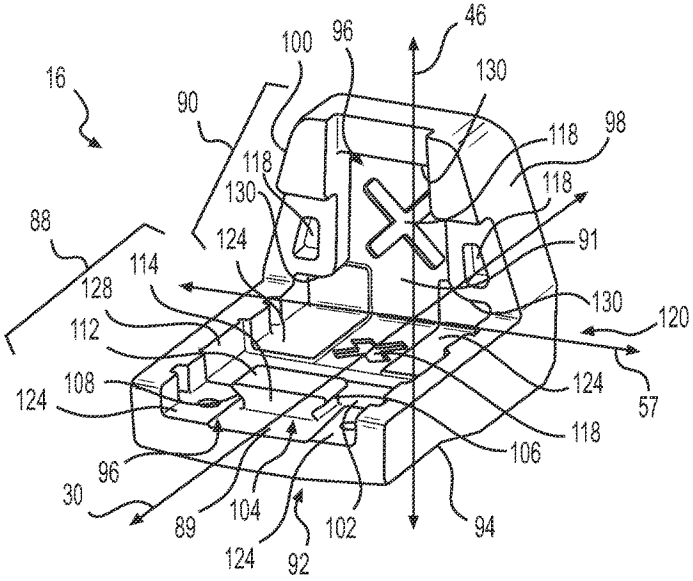
FIG. 13 is a perspective view of an exemplary disclosed wear member of the wear member system of FIG. 3.
Figure 16:
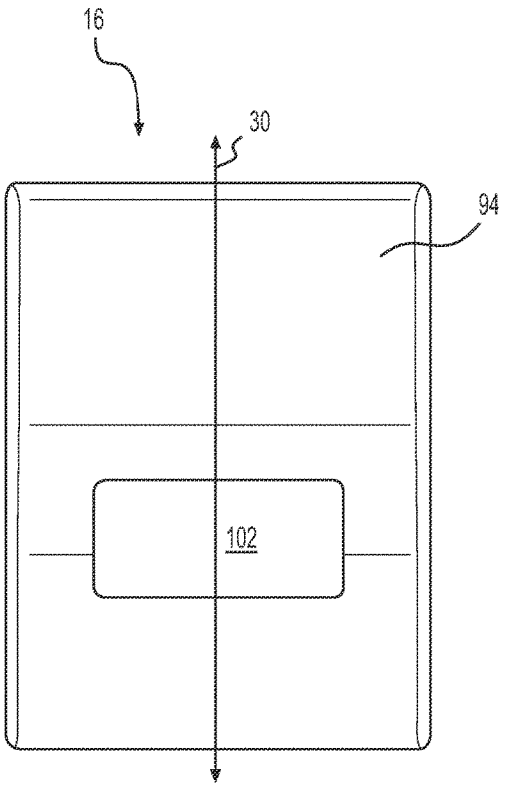
FIG. 16 is a bottom view of the wear member of FIGS. 13-15.
Figure 15:
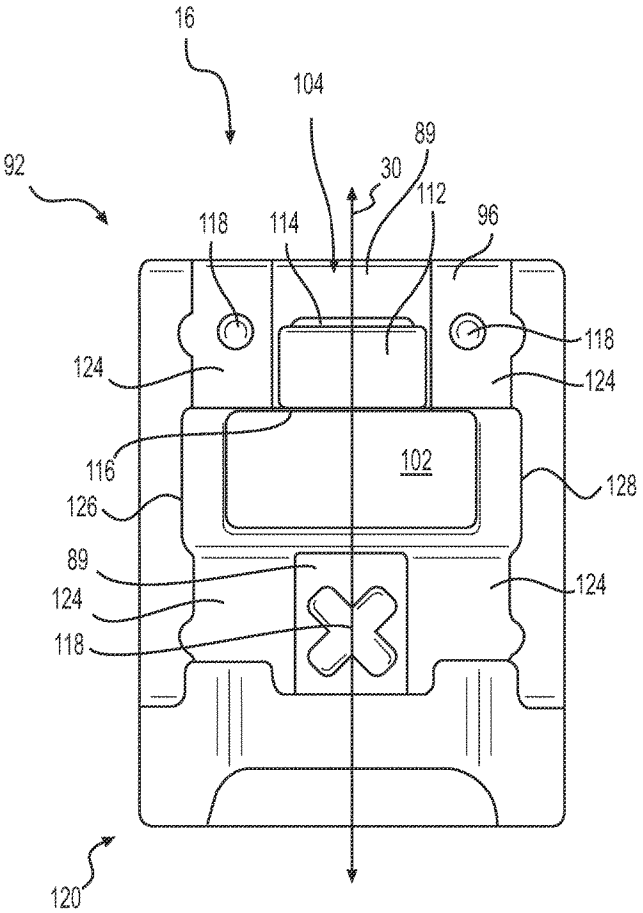
FIG. 15 is a top view of the wear member of FIGS. 13-14.

As shown in FIGS. 13, 15, and 18, wear indicators 118 defined by wear member 16 may be an "X" shaped recess. It is contemplated that other recess shapes may be utilized. It is also contemplated that additional wear indicators 118 may be formed in wear member 16. For example, as shown in FIG. 15, first wear member portion 88 may also define circular shaped recess wear indicators 118 positioned between rectangle-shaped second opening 102 and first end 92 on either side of receiving pocket 96. In yet another example, as shown in FIGS. 13 and 18, second wear member portion 90 may also define additional wear indicators 118 defined outside of receiving pocket 96. These additional wear indicators may be any of a variety of shapes, for example, a square, a circle, a triangle, a quadrilateral, or other shape. These wear indicators 118 formed outside of receiving pocket 96 may have a recessed depth greater than that of the other wear indicators 118.

Figure 14:
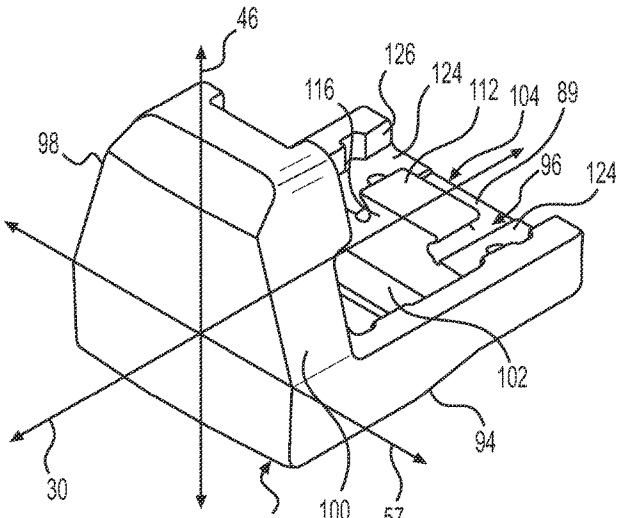
FIG. 14 is another perspective view of the wear member of FIG. 13, from a different angle.

Referring to FIGS. 13-15, wear member 16 may also include a plurality of loading pads 124 configured to contact mounting base 22. Loading pads 124 may be configured to transfer loads from wear member 16 to mounting base 22 in directions generally perpendicular to first wear member portion 88, generally perpendicular to second wear member portion 90, and generally parallel to both first wear member portion 88 and second wear member portion 90. Loading pads 124 may include protrusions within receiving pocket 96. The protrusions may be formed of raised portions of receiving pocket 96 surfaces. Receiving pocket 96 surfaces may include first inward surface 89, side walls 126, 128, and second inward surface 91. The protrusions may be generally plateau-shaped. Loading pads 124 may be positioned at corners of receiving pocket 96. Loading pads 124 may be configured to correspond and contact loading pads 86 of mounting base 22. All loading pads 124 raised from first inward surface 89 may be substantially level. All the loading pads 124 raised from second inward surface 91 may be substantially level. All the loading pads 124 raised on each individual side wall 126,128 may be substantially level.

Second wear member portion 90 may also have one or more loading surfaces 130 formed by side walls of receiving pocket 96, as depicted in FIGS. 13 and 18. Loading surfaces 130 may extend out from second inward surface 91 parallel to first wear member portion 88 over the portion of receiving pocket 96 defined by first wear member portion 88. Loading surfaces 130 are configured to contact loading pads 86 of first base portion 28 and upper end 58 of second base portion 44 when mounting base 22 is coupled to wear member 16. Loading surfaces 130 may be configured to transfer loads onto mounting base 22 that are perpendicular to first wear member portion 88.

As shown in FIG. 3, wear member 16 may be wider than mounting base 22 along latitudinal direction 57, longer than mounting base 22 along longitudinal direction 30, and taller than mounting base along vertical direction 46. In other words, wear member 16 may be configured such that it may substantially surround mounting base 22 when coupled together in a mounted positioned as demonstrated in FIG. 3.

Wear member 16 may vary in size thus enabling wear member 16 to fit a variety of different sizes of tool 12. Although the size of wear member 16 may vary, the ratio of various dimensions may remain generally the same regardless of the variation in the overall size of wear member 16 and corresponding wear member system 14.

Referring to FIG. 17, a ratio of a maximum width 160 of first wear member portion 88 to a maximum width 162 of second wear member portion 90 at an upper end 121, along a direction parallel to both the first wear member portion 88 and second wear member portion 90, may be between about 1 and about 2. In some embodiments, the ratio may be between about 1.25 and about 1.75. In some other embodiments, the ratio may be between about 1.5 and about 1.6. For example, the ratio may be about 1.55. The ratio of the widths may correlate with angle $\lambda$ of converging side surfaces 98, 100 of second wear member portion 90. As a result of the converging sides and ratio of the widths, wear member systems 14 may be mounted in closer proximity to one another along the heel of the tool without having interference issues as illustrated in FIG. 2.

Figure 19:
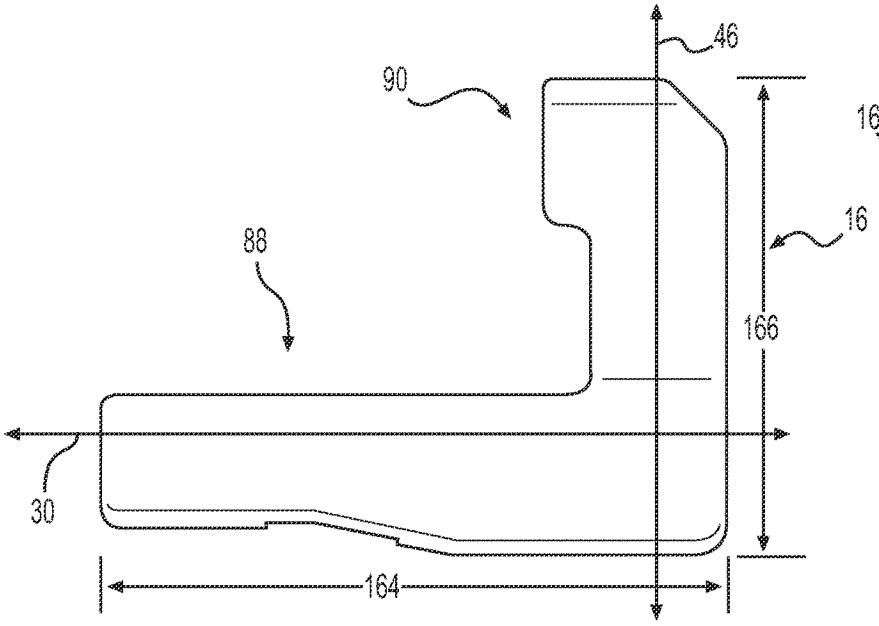
FIG. 19 is a right side view of the wear member of FIGS. 13-18.

Referring to FIG. 19, a ratio of a maximum length 164 of first wear member portion 88, along a direction generally perpendicular to second wear member portion 90, to a maximum height 166 of second wear member portion 90, along a direction generally perpendicular to first wear member portion 88, may be between about 1.15 and about 1.5. In some embodiments, the ratio may be between about 1.3 and about 1.35. For example, the ratio may be about 1.32. This ratio may correlate with the corresponding maximum length and maximum height ratio of mounting base 22. This range of ratios may be beneficial because they may provide a suitable size wear member 16 relative to the size of tool 12, while not being so large and heavy that installation and replacement of wear member 16 becomes problematic.

The dimensions of the mounting base 22 relative to wear member 16 may also remain generally the same regardless of the variation in the overall size of wear member system 14. For example, referring to FIGS. 8 and 17, a ratio of width 160 of first wear member portion to width 146 of first base portion 28 may be between about 1.15 and about 1.5. In some embodiments the ratio may be between about 1.3 and about 1.35, for example, about 1.32. Referring again to FIGS. 8 and 17, a ratio of width 162 of second wear member portion 90 to width 148 of second base portion 44 may be between about 1.55 and about 1.8. In some embodiments, the ratio may be between about 1.65 and about 1.70, for example, about 1.68. Referring to FIGS. 10 and 19, a ratio of length 164 of first wear member portion 88 to length 150 of first base portion 28 may be between about 1.0 and about 1.4. In some embodiments, the ratio may be between about 1.1 and about 1.3, for example about 1.20. These ratios of wear member 16 to mounting base 22 may be beneficial in order to ensure the size of both mounting base 22 and wear member 16 may be suitable based on the size of tool 12. In addition, these ratios may provide an appropriate amount of material surrounding mounting base 22 so that the life expectancy of wear member 16 may be sufficiently long.

Figure 21:
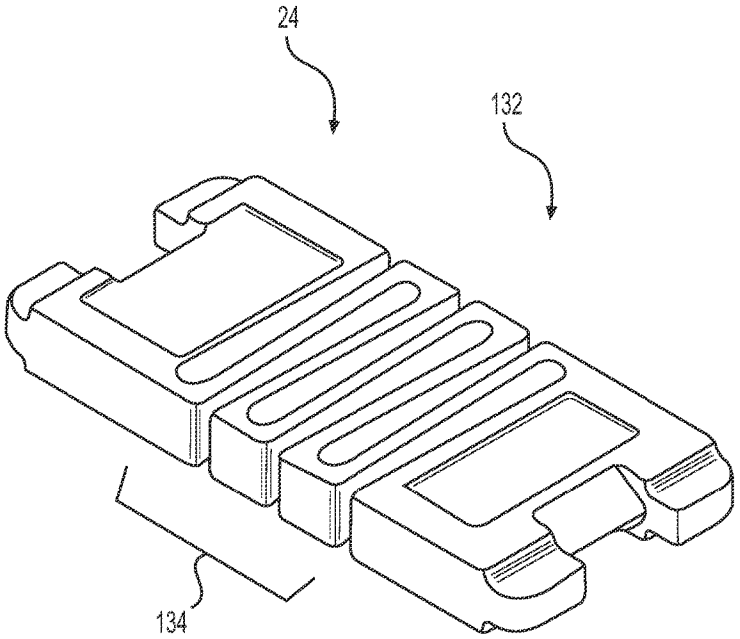
FIG. 21 is a perspective view of an exemplary disclosed retainer of the wear member system of FIG. 3.

Referring to FIGS. 3 and 21, retainer 24, may have a generally flat rectangular shaped body portion 132 which may be adapted for placement within the rectangle-shaped portion 62 of first opening 60. Retainer 24 may be configured such that when installed within rectangle-shaped portion 62 of first opening 60, it may maintain wear member 16 in the mounted position on mounting base 22. The body may be constructed of steel, or any suitable substantially non-compressible material. Retainer 24 may also be provided with a spring portion 134 along body 132, which may be adapted to provide body 132 with sufficient resiliency from end to end to permit the length of body 132 to be compressed when a compressive force is applied to the ends, but be sufficiently rigid from side to side to enable retainer 24 to withstand compressive loads applied to the sides without incurring any significant distortion. It is contemplated that other retainer designs may be utilized to maintain the mounted position of wear member 16. For example, first opening 60 and retainer 24 may comprise other shapes besides a rectangle-shape.

Figure 22:
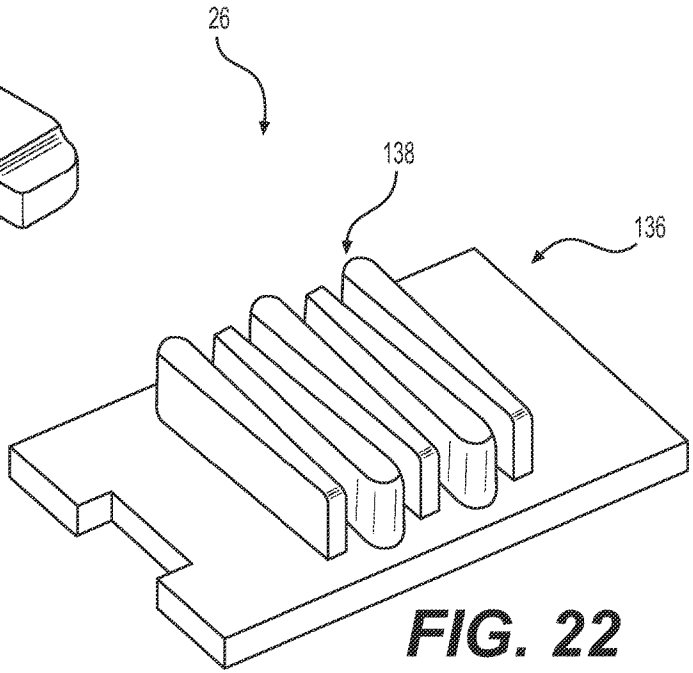
FIG. 22 is a perspective view of an exemplary disclosed plug of the wear member system of FIG. 3.

FIG. 22 shows one embodiment of plug 26. Plug 26 may have a flat base 136 and a plurality of projections 138 that correspond in shape to spring portion 134 of retainer 24, thereby enabling projections 138 of plug 26 to be inserted into spring portion 134 of retainer 24. Plug 26 when inserted into retainer 24 may prevent earthen material from getting lodged in spring portion 134. Without plug 26, earthen material may get lodged in spring portion 134, thus restricting compression of spring portion 134 and making for difficult removal of retainer 24.

Figure 28:
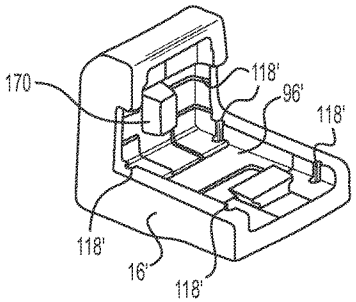
FIG. 28 is a perspective view of an exemplary disclosed wear member of the wear member system of FIG. 26.
Figure 27:
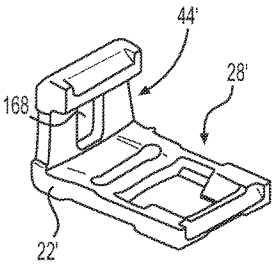
FIG. 27 is a perspective view of an exemplary disclosed mounting base of the wear member system of FIG. 26.
Figure 26:
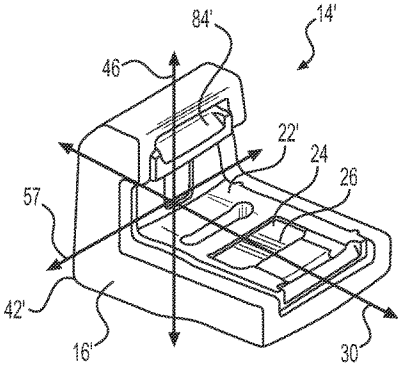
FIG. 26 is a perspective view of another exemplary disclosed wear member system.

Another embodiment of a wear member system is shown in FIGS. 26-28. Wear member system 14' may be substantially similar to wear member system 14. For example, wear member system 14' may include a wear member 16', a mounting base 22', retainer 24, and plug 26. Mounting base 22' may be configured to attach (e.g., fixedly) to first surface 18 and second surface 20 of tool 12. Wear member 16' may be configured to removably couple to mounting base 22'. Retainer 24 may be configured to keep wear member 16 coupled to mounting base 22, and plug 26 may be configured to protect retainer 24.

As shown in FIGS. 26-28, mounting base 22' may be similar in many respects to mounting base 22. However, there are noticeable differences between the embodiments. For example, a second base portion 44' of mounting base 22' may be generally the same width as a first base portion 28' at second end 42', whereas second base portion 44 is narrower than first base portion 28 at second end 42. As a result of the increased width of second base portion 44' relative to first base portion 28, a width of second chamfer surface 84' may also be increased. The shape of receiving pocket 96' defined by wear member 16' may be correspondingly shaped in order to receive the wider second base portion 44' of mounting base 22'.

Another difference between the embodiments includes, for example, how second base portion 44' may define a tab opening 168 configured to receive a tab 170 defined by wear member 16'. Wear member 16 and mounting base 22 have neither tab opening 168 nor tab 170. As shown in FIG. 26, tab opening 168 may be configured to receive tab 170 through second base portion 44'. The surfaces of tab 170 may be configured to contact the corresponding surfaces of tab opening 168 when wear member 16' is coupled to mounting base 22'. The surfaces of tab opening 168 and tab 170 may be configured to function similarly to loading surface 130 of wear member system 14. In other words, tab 170 may be configured to transfer loads applied to wear member 16' to mounting base 22' via tab opening 168. The loads transferred by tab opening 168 and tab 170 may be applied to wear member 16' along vertical direction 46 and latitudinal direction 57 to mounting base 22'.

Yet another example of a difference between wear member system 14 and 14' includes the difference between the wear indicators 118 of wear member 16 and wear indicators 118' of wear member 16'. Wear member 16' may include circular wear indicators 118' formed along the side walls of receiving pocket 96', in contrast to wear indicators 118, which as described herein, may be both circular and "X" shaped and positioned within receiving pocket 96. Additional minor differences between wear member system 14 and 14' may be identifiable from the figures.

INDUSTRIAL APPLICABILITY

The disclosed wear member systems may be applicable to any tool that has a heel with first and second surfaces that are generally perpendicular. The wear member system may have various advantages over prior art wear member systems. For example, they may be relatively easy to remove/and or install regardless of tool size. In addition, a first and second surface of a tool may be protected using a single mounting base and wear member system. Yet another advantage may be serviceability based on the multiple surface wear indicators, which may provide an indication of when the wear member should be replaced.

Figure 25:
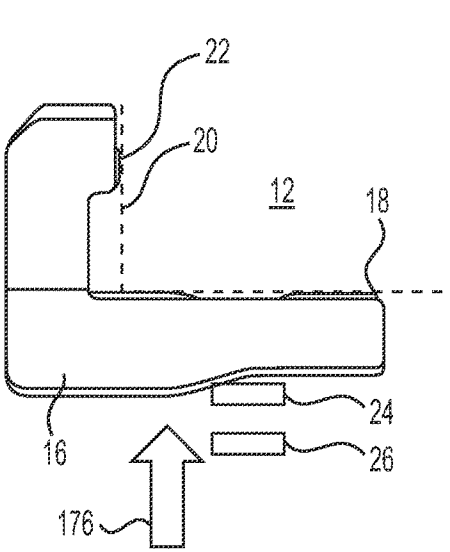
FIGS. 23, 24, and 25 are side views of the wear member system of FIG. 3 in various states of assembly.
Figure 24:
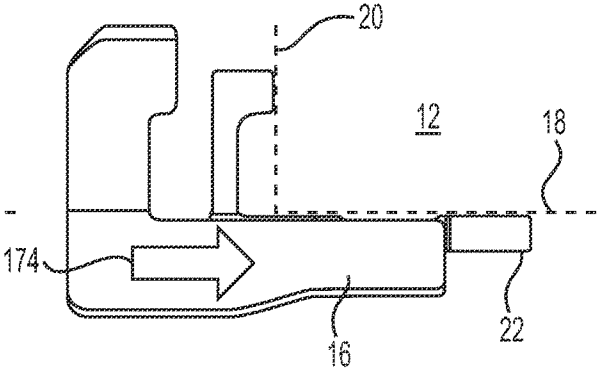
Figure 23:
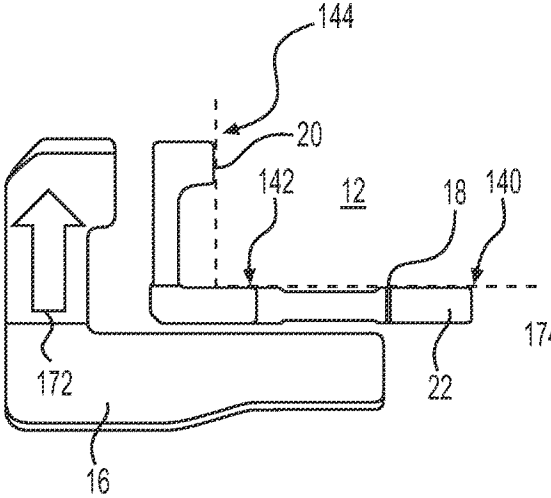

Wear member 16 and mounting base 22 provide a quick and simple system for mounting and removing wear member 16 onto and from mounting base 22. The mounting and removal of wear member 16 may be accomplished without special tools, requiring only a common pry bar. FIGS. 23-25 depict the mounting wear member 16 and mounting base 22 in various states of assembly. As described herein, mounting base 22 may be attached to tool 12 via welding. Mounting base 22 may be welded to tool 12 at a first location 140 and a second location 142 along first surface 18, and at a third location 144 along second surface 20. Once mounting base 22 is attached to tool 12, wear member 16 may be coupled to mounting base 22 by movement of wear member 16 in a first direction toward mounting base 22, as shown by arrow 172 in FIG. 23. Projection 104 of wear member 16 should be substantially aligned with the rectangle-shaped portion 62 of first opening 60 in order to allow insertion of projection 104 into first opening 60.

As shown in FIG. 24, wear member 16 may first be positioned on mounting base 22 in an offset position where projection 104 may be in inserted within rectangle-shaped portion 62 of first opening 60 to the left of notch-shaped portion 64. Wear member 16 may then be slid to the right in a second direction, as shown by arrow 174, into a mounted position. As wear member 16 is slid to the right, projection 104 may move from rectangle-shaped portion 62 of first opening 60 into notch-shaped portion 64 thereby engaging engagement surfaces 106, 108 of projection 104 with angled surfaces 76, 78 of notch-shaped portion 64 into an opposing interlocking relationship with each other. The mating of engagement surfaces 106, 108 and angled surfaces 76, 78 may form a dovetail like joint.

In the mounted position, rectangle-shaped portion 62 of first opening 60 may be brought in alignment with rectangle-shaped second opening 102 enabling insertion of retainer 24 through wear member 16 into position within rectangle-shaped portion 62 of first opening 60, as shown in FIG. 25. Retainer 24 may be inserted into rectangle-shaped portion 62 of first opening 60 in a third direction, as shown by arrow 176. With one end of retainer 24 being positioned in first opening 60 under one of the flanges 72, 74, a pry bar may be inserted at the other end of retainer 24. By applying a reasonable force to retainer 24 with the screw driver, retainer 24 may be sufficiently compressed in length to move the free end of the retainer 24 past the other flange and seat retainer 24 fully within rectangle-shaped portion 62 of first opening 60. When installed, retainer 24 may prevent movement, in the longitudinal direction 30 of wear member 16, relative to mounting base 22. Retainer 24 may prevent movement by maintaining the position of projection 104 within notch-shaped portion 64 of first opening 60. Following the installation of retainer 24, plug 26 may also be installed by insertion through rectangle-shaped second opening 102 in wear member 16.

Wear member 16 may be uncoupled from mounting base 22 by performing the above steps in reverse. For example, first plug 26 (if installed) may be removed. Next, retainer 24 may be removed and then wear member 16 may be slid to the left until projection 104 is aligned with rectangle-shaped portion 62 of first opening 60. Once projection 104 is aligned, wear member 16 may be dropped away from mounting base 22. A new wear member 16 may then be installed.

Another advantage of wear member system 14 is versatility. Wear member system 14 may protect a portion of both first surface 18 and second surface 20 of tool 12 at heel 15 or 17 utilizing just a single wear member 16. In contrast, single surface wear members often require two separate mounting bases and wear members, one for first surface 18 and one for second surface 20, in order to protect each heel section of the tool. Thus, wear member system 14 may reduce installation time and cost by protecting both surfaces with one wear member and one mounting base.

Yet another advantage of wear member system 14 and wear member 16 may be the one or more wear indicators 118 that may provide an indication of when wear member 16 should be replaced. In some applications, wear member 16 may experience different amounts of wear depending on the surface of wear member 16. As a result, it may be beneficial to have wear indicators 118 formed on multiple surfaces of wear member 16 and in multiple locations on the surfaces to provide wear indication at multiple locations. In some applications, it may be beneficial to periodically rotate the position of wear members 16 on tool 12 in order to achieve even wearing of wear members 16 and increase the usable life of each wear member.

It will be apparent to those skilled in the art that various modifications and variations may be made to the wear member system, including the mounting base and wear member. Other embodiments will be apparent to those skilled in the art from consideration of the specification and practice of the disclosed wear member system. It is intended that the specification and examples be considered as exemplary only, with a true scope being indicated by the following claims and their equivalents.

What is claimed is:

1. A mounting base for removably coupling a wear member to a tool, comprising:

a generally planar first base portion having an inward surface configured to be attached to the tool; and a generally planar second base portion extending from the first base portion in a direction generally perpendicular to the first base portion, and having an inward surface configured to be attached to the tool, wherein the first base portion defines an opening including a notch-shaped portion and a rectangle-shaped portion, wherein the notch-shaped portion includes a pair of engagement surfaces extending from the inward surface of the first base portion to an outward surface of the first base portion opposite the inward surface, and wherein the engagement surfaces define an inside perimeter of the notch-shaped portion at the inward surface; the engagement surfaces define an outside perimeter of the notch-shaped portion at the outward surface; and the inside perimeter is larger than the outside perimeter.

2. The mounting base of claim 1, wherein:

the first base portion has a first chamfer surface extending from an end of the inward surface of the first base portion, and away from the tool when the inward surface is attached to the tool; and the second base portion has a second chamfer surface extending from an end of the inward surface of the second base portion, and away from the tool when the inward surface of the second base portion is attached to the tool.

3. The mounting base of claim 2, wherein a ratio of a width of the first chamfer surface to a width of the second chamfer surface, along a direction generally parallel to both the first and second base portions, is between about 2 and about 3.

4. The mounting base of claim 1, wherein the second base portion has a pair of opposite sides that converge toward each other as they extend away from the first base portion.

5. The mounting base of claim 1, wherein the inward surface of the first base portion is concave.

6. The mounting base of claim 1, wherein the first base portion defines a plurality of loading pads configured to contact the tool and the wear member.

7. The mounting base of claim 6, wherein the plurality of loading pads are protrusions of the first base portion.

8. The mounting base of claim 7, wherein the protrusions are generally plateau-shaped.

9. The mounting base of claim 6, wherein the plurality of loading pads are positioned at corners of the first base portion.

10. The mounting base of claim 6, wherein the loading pads are configured to receive loads from the wear member in directions generally perpendicular to the planar first base portion, generally perpendicular to the planar second base portion, and generally parallel to both the planar first base portion and the planar second base portion.

11. The mounting base of claim 1, wherein a ratio of a maximum width of the first base portion to a maximum width of the second base portion, along a direction generally parallel to both the first and second base portions, is between about 1.75 and about 2.25.

12. The mounting base of claim 1, wherein a ratio of a maximum length of the first base portion, along a direction generally perpendicular to the second base portion, to a maximum height of the second base portion, along a direction generally perpendicular to the first base portion, is between about 1.7 and about 1.8.

* * * * *